US010336062B2

(12) United States Patent
Sreenivasan et al.

(10) Patent No.: US 10,336,062 B2
(45) Date of Patent: Jul. 2, 2019

(54) SYSTEMS AND METHODS FOR PRECISION INKJET PRINTING

(71) Applicant: Board of Regents, The University of Texas System, Austin, TX (US)

(72) Inventors: S. V. Sreenivasan, Austin, TX (US); Brent Snyder, Austin, TX (US); Miaomiao Yang, Austin, TX (US); Shrawan Singhal, Austin, TX (US); Ovadia Abed, Austin, TX (US)

(73) Assignee: Board of Regents, The University of Texas System, Austin, TX (US)

( * ) Notice: Subject to any disclaimer, the term of this patent is extended or adjusted under 35 U.S.C. 154(b) by 144 days.

(21) Appl. No.: 15/457,283

(22) Filed: Mar. 13, 2017

(65) Prior Publication Data

US 2017/0259560 A1 Sep. 14, 2017

Related U.S. Application Data

(60) Provisional application No. 62/308,056, filed on Mar. 14, 2016.

(51) Int. Cl.
*B41J 2/045* (2006.01)

(52) U.S. Cl.
CPC ..... *B41J 2/04508* (2013.01); *B41J 2/0456* (2013.01); *B41J 2/0458* (2013.01); *B41J 2/04561* (2013.01); *B41J 2/04581* (2013.01)

(58) Field of Classification Search
CPC .. B41J 2/04508; B41J 2/0456; B41J 2/04561; B41J 2/0458; B41J 2/04581
See application file for complete search history.

(56) References Cited

U.S. PATENT DOCUMENTS

| | | | | |
|---|---|---|---|---|
| 9,352,561 | B2 * | 5/2016 | Harjee | B41J 2/07 |
| 2011/0050803 | A1 | 3/2011 | Wu et al. | |
| 2013/0033536 | A1 | 2/2013 | Sawase | |

FOREIGN PATENT DOCUMENTS

| | | |
|---|---|---|
| JP | 2015/168084 | 9/2015 |
| WO | 2004/049466 | 6/2004 |
| WO | 2016/004125 | 1/2016 |

OTHER PUBLICATIONS

Microfab Technologies, Inc., "Drive Waveform Effects on Ink-Jet Device Performance," Microfab Technote 99-03, 1999; 4 pages.
Microfab Technologies, Inc., "Satellites occurrence and approaches to eliminate them," Microfab Technote 99-03, 2007; 4 pages.
K.-S. Kwon and W. Kim, "A waveform design method for high-speed inkjet printing based on self-sensing measurement," *Sensors and Actuators A: Physical*, vol. 140, pp. 75-83, 2007; 9 pages.

(Continued)

*Primary Examiner* — Thinh H Nguyen
(74) *Attorney, Agent, or Firm* — Baker Botts L.L.P.

(57) ABSTRACT

Systems and methods for precision inkjet printing are disclosed. A method determining an actuation parameter associated with a pressure waveform. Based on the pressure waveform, the method also includes actuating a print head to eject a droplet from a nozzle and acquiring an image of the droplet. The method further includes processing the acquired image to estimate a volume of the droplet and based on the estimated volume of the droplet and a target volume, adjusting the actuation parameter.

26 Claims, 3 Drawing Sheets

(56) References Cited

OTHER PUBLICATIONS

K.-S. Kwon, "Waveform design methods for piezo inkjet dispensers based on measured meniscus motion," *Microelectromechanical Systems, Journal of*, vol. 18, pp. 1118-1125, 2009; 8 pages.
Gan, H. Y., et al. "Reduction of droplet volume by controlling actuating waveforms in inkjet printing for micro-pattern formation." Journal of micromechanics and microengineering 19.5 (2009); 8 pages.
Nallan, Himamshu C., et al. "Systematic design of jettable nanoparticle-based inkjet inks: rheology, acoustics, and jettability." Langmuir 30.44 (2014): 13470-13477; 8 pages.
Liu, Yu-Feng, et al. "Control of droplet formation by operating waveform for inks with various viscosities in piezoelectric inkjet printing." Applied Physics A 111.2 (2013): 509-516; 8 pages.
Kwon, Kye-Si, et al. "Inkjet jet failures and their detection using piezo self-sensing." Sensors and Actuators A: Physical 201 (2013): 335-341; 7 pages.
D. Bogy and F. E. Talke, "Experimental and theoretical study of wave propagation in drop-on-demand ink jet devices," *Journal of research and development*, vol. 28, pp. 314-321, 1984; 8 pages.
K.-S. Kwon, "Experimental analysis of waveform effects on satellite and ligament behavior via in situ measurement of the drop-on-demand drop formation curve and the instantaneous jetting speed curve," *Journal of micromechanics and microengineering*, vol. 20, p. 115005, 2010; 14 pages.
N. Reis, C. Ainsley, and B. Derby, "Ink-jet delivery of particle suspensions by piezoelectric droplet ejectors," *Journal of Applied Physics*, vol. 97, p. 094903, 2005; 6 pages.
E. Tekin, P. J. Smith, and U. S. Schubert, "Inkjet printing as a deposition and patterning tool for polymers and inorganic particles," *Soft Matter*, vol. 4, pp. 703-713, 2008; 11 pages.
B. Derby and N. Reis, "Inkjet printing of highly loaded particulate suspensions," *Mrs Bulletin*, vol. 28, pp. 815-818, 2003; 4 pages.
J. E. Fromm, "Numerical calculation of the fluid dynamics to drop-on-demand jets," *IBM Journal of Research and Development*, vol. 28, pp. 322-333, 1984; 12 pages.
Kim, Changsung Sean, et al. "Modeling and characterization of an industrial inkjet head for micro-patterning on printed circuit boards." Computers & Fluids 38.3 (2009): 602-612; 11 pages.
Zeng, Jun, et al. "Multi-disciplinary simulation of piezoelectric driven microfluidic inkjet." ASME 2009 International Design Engineering Technical Conferences and Computers and Information in Engineering Conference. American Society of Mechanical Engineers, 2009; 4 pages.
A. A. Khalate, X. Bombois, G. Scorletti, R. Babuska, S. Koekebakker, and W. de Zeeuw, "A Waveform Design Method for a Piezo Inkjet Printhead Based on Robust Feedforward Control," *Microelectromechanical Systems, Journal of*, vol. 21, pp. 1365-1374, 2012; 9 pages.
A. Fulton, "Drop volume modulation via modulated contact angle in inkjet systems," *ProQuest Dissertations and Theses* p. 90, 2014; 87 pages.
C. L. Herran, Y. Huang, and W. Chai, "Performance evaluation of bipolar and tripolar excitations during nozzle-jetting-based alginate microsphere fabrication," *Journal ofMicromechanics and Microengineering*, vol. 22, p. 085025, 2012; 11 pages.
C. Rensch, "Creation of Small Microdrops," Microfab Technologies, Inc., Plano, TX Technote 99-03, 2006; 51 pages.
I. Hutchings, G. Martin, and S. Hoath, "High speed imaging and analysis of jet and drop formation," *Journal of Imaging Science and Technology*, vol. 51, pp. 438-444, 2007; 7 pages.
K.-S. Kwon, M.-H. Jang and H.-S. Ko, "Tracking based inkjet measurement for evaluating high frequency ink jetting," in *NIP & Digital Fabrication Conference*, 2014, pp. 171-175; 5 pages.
K.-S.Kwon, M.-H. Jang, H. Y. Park, and H.-S. Ko, "An inkjet vision measurement technique for high-frequency jetting," *Review of Scientific Instruments*, vol. 85, p. 065101, 2014; 11 pages.
R. M. Verkouteren and J. R. Verkouteren, "Inkjet metrology II: resolved effects of ejection frequency, fluidic pressure, and droplet number on reproducible drop-on-demand dispensing," *Langmuir*, vol. 27, pp. 9644-9653, 2011; 10 pages.
A. Khalate, X. Bombois, G. Scorletti, and R. Babuška, "Drop-on-demand inkjet printhead performance improvement using robst feedforward control," in *Decision and Control and European Control Conference* (*CDC-ECC*), *2011 50th IEEE Conference on*, 2011, pp. 4183-4188; 6 pages.
A. Khalate, X. Bombois, G. Scorletti, R. Babuška, S. Koekebakker, and W. De Zeeuw, "A waveform design method for a piezo inkjet printhead based on robust feedforward control," *Microelectromechanical Systems, Journal of*, vol. 21, pp. 1365-1374, 2012; 9 pages.
A. A. Khalate, X. Bombois, R. Babuška, H. Wijshoff, and R. Waarsing, "Performance improvement of a drop-on-demand inkjet printhead using an optimization-based feedforward control method," *Control Engineering Practice*, vol. 19, pp. 771-781, 2011; 37 pages.
A. A. Khalate, X. Bombois, S. Ye, R. Babuška, and S. Koekebakker, "Minimization of cross-talk in a piezo inkjet printhead based on system identification and feedforward control," *Journal of Micromechanics and Microengineering*, vol. 22, p. 115035, 2012; 34 pages.
M. Ezzeldin, P. P. J. van den Bosch, A. Jokic, and R. Waarsing, "Model-free optimization based feedforward control for an inkjet printhead," in *Control Applications* (*CCA*), *2010 IEEE International Conference on*, 2010, pp. 967-972; 6 pages.
International Search Report and Written Opinion for PCT Patent Application No. PCT/US2017/022054, dated Jun. 26, 2017; 18 pages.

* cited by examiner

SYSTEMS AND METHODS FOR PRECISION INKJET PRINTING

RELATED APPLICATIONS

This application claims priority to U.S. Provisional Application Ser. No. 62/308,056 filed Mar. 14, 2016, and which is incorporated herein by reference in its entirety.

GOVERNMENT SUPPORT CLAUSE

This invention was made with government support under Grant no. EEC1160494 and Grant no. ECCS1120823 awarded by the National Science Foundation. The government has certain rights in the invention.

TECHNICAL FIELD

The present disclosure relates generally to inkjet printing and, more particularly, to systems and methods for precision inkjet printing.

BACKGROUND

Inkjet devices, such as printers, are configured to print an image onto a substrate, such as paper, plastic, or other material. Inkjet devices generally include a print head that ejects ink droplets selectively from nozzles on the print head onto the substrate, also referred to as "inkjetting." The ink droplets deposit on the substrate and a desired image is printed.

Inkjetting is a complex phenomenon involving several different physical processes interacting together. There are a variety of types of inkjet devices that use different mechanisms for inkjetting. For example, inkjet devices may include print heads using mechanisms such as piezoelectric, thermal, electrohydrodynamic, and other suitable mechanisms. Piezoelectric inkjets use a piezoelectric element to acoustically excite ink in a channel behind the nozzle. The resulting changes in pressure at the nozzle cause droplets to eject. The piezoelectric element is operated by actuation waveforms, which are short electrical pulses generated for each ejection of a droplet.

For piezoelectric inkjets, the pressure at the orifice is based on a pressure waveform, which is typically a sequence of voltage ramps and plateaus on the order of approximately 1-100 volts (V) and approximately 1-100 microseconds (μs) in duration. Each time the voltage changes, the piezoelectric element deforms, which initiates acoustic pressure waves that travel to the nozzle and to the fluid reservoir. When the pressure waves reach the nozzle, the resulting changes in pressure control the dynamics of the fluid at the nozzle, which may result in the formation of a fluid column that ejects into one or more droplets from the nozzle.

When the ink stream breaks up into droplets, it may result in a series of uniform large droplets that are each separated by one or more much smaller droplets referred to as "satellites." The shape of the pressure waveform determines the fluid dynamics at the nozzle, which determine multiple characteristics of the fluid droplets, such as the droplet volume and velocity and the satellite volume and size. It is difficult to correlate the pressure waveform and resulting droplet formation and velocity.

The pressure waveform may vary based on the particular implementation. A standard pressure waveform is the unipolar waveform that consists of two rising and falling impulses in sequence. The unipolar waveform is parameterized by the peak voltage and the dwell time, which is the time elapsed between the pulses. For a particular fluid and inkjet, an optimal dwell time for a unipolar waveform exists when the ejected droplet momentum is maximized at a given voltage.

Other pressure waveforms may be utilized based on the goals of a particular implementation. For example, reducing droplet volume may require advanced waveforms to induce complex pressure gradients at the orifice. Additionally, fluids with challenging rheological properties may be prone to unstable jetting and may not be jettable with the standard unipolar waveform.

Multiple methods have been proposed and utilized to improve piezoelectric inkjets, which may include optimizing droplet volumes. Many of these methods provide for the inclusion of non-dimensional numbers and may also vary the pressure waveform, such as by using a bipolar waveform with modifications to dwell times. Numbers proposed and used in some methods include the Ohnesorge number, a related Z number, and/or other ratios. Such numbers relate to the jettability and/or printability of a particular fluid with a particular inkjet. Limits are often proposed for the numbers based on different fluids, such as wax suspensions or low viscosity inks, and the structure of inkjet nozzles, such as orifice radius, orifice length, or orifice diameter. The limits have taken into account fluid parameters such as fluid viscosity, viscous dissipation, fluid surface tension, fluid density and/or the formation of satellites.

With respect to varied pressure waveforms, often a manual trial-and-error process is performed to select the optimal waveform. For fluids and performance requirements that fall into typical operating conditions for an inkjet device, a simple unipolar waveform may be easily optimized for stable jetting. However, in order to jet fluids with challenging properties, while specifying droplet resolution, requires increasingly complex waveforms. As the complexity of the waveform increases, its versatility increases but the dimensionality of the problem explodes. While multiphysics simulations and models may predict droplet formation, these models are extremely complex, non-linear, application-specific, excessively time consuming, and are non-invertible in nature. Furthermore, no analytic models exist that are useful for predicting droplet volumes from actuation waveforms. Additionally, any waveform tuning is specific to that particular combination of fluid and inkjet device.

The challenge of methods using non-dimensional numbers and/or varied waveforms is that the methods may be too conservative, e.g., artificially confine the limits of jetting performance. These methods also may depend on the fluid rheology and inkjet device geometry, without taking into account the complex coupling between the piezo-structural materials, actuation dynamics, inkjet geometry and fluid rheology. Manual tuning, as stated above, is only limited to simple waveforms with few parameters. Accordingly, a need has arisen to automatically optimize complex pressure waveforms to control droplet resolution while maintaining placement accuracy for any combination of material and inkjet device.

SUMMARY

In some embodiments, a method for precision inkjet printing includes determining an actuation parameter associated with a pressure waveform. Based on the pressure waveform, the method also includes actuating a print head to eject a droplet from a nozzle and acquiring an image of the droplet. The method further includes processing the acquired image to estimate a volume and a velocity of the droplet and based on the estimated volume and velocity of the droplet and a target volume and velocity, adjusting the actuation parameter.

BRIEF DESCRIPTION OF THE DRAWINGS

For a more complete understanding of the present invention and its features and advantages, reference is now made to the following description, taken in conjunction with the accompanying drawings, in which.

DETAILED DESCRIPTION

Figure 1:
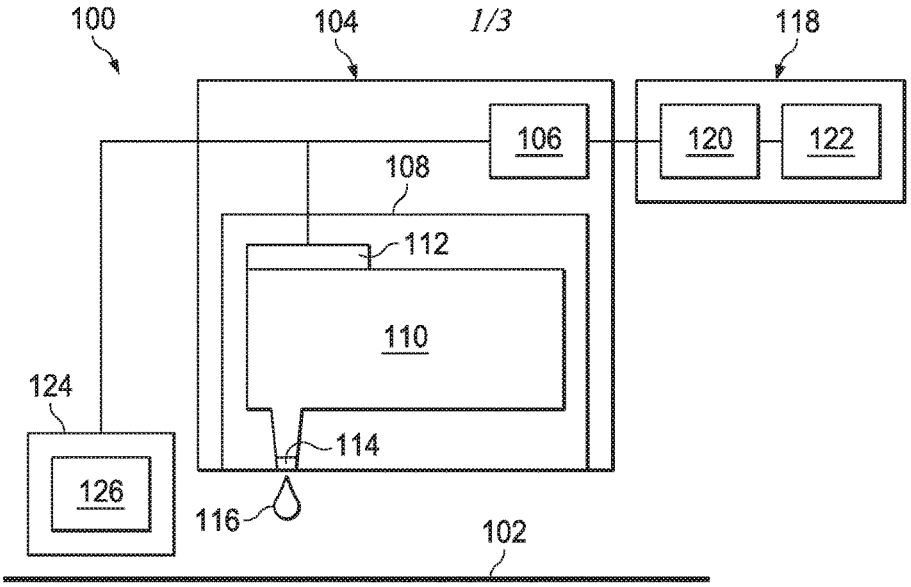
FIG. 1 is a schematic diagram of a precision inkjet system.

The present disclosure is directed to a system and method for precision inkjet printing. In some embodiments, a method for precision inkjet printing includes determining a particular pressure waveform and actuation parameters. An acquisition device, including one or more cameras, acquires images of the droplets during ejection and deposition on a substrate. The images are processed and droplet volumes and velocities are estimated and refined. An automatic tuning algorithm assesses the droplet volumes and/or velocities based upon optimization goals and/or target volumes and velocities. Based on the assessment, adjustments may be made to the particular pressure waveform and/or the actuation parameters.

Ideally, the automated tuning algorithm may use a forward model based on the internal flow or pressure measurements inside the inkjet device. However, the lack of such sensors and the corresponding inability to sense pressure during actuation and fluid flow altogether in addition to transmission time delays between actuation and pressure at the orifice that exceed the duration of the actuation waveform, make real-time closed-loop feedback control difficult.

A particular pressure waveform may be selected based on the inkjet device being used, the fluid to be ejected, or any other suitable parameter. For example, pressure waveforms may include a Unipolar, Bipolar, M-Shaped, and W-Shaped waveforms (where the W-Shaped waveform is the inverted version of the M-Shaped waveform). Pressure waveforms consist of a continuous piecewise series of ramps and plateaus, which may be mapped to a control space vector of finite length. The pressure waveform shape is limited by the number of actuation parameters and actuation parameter resolution defined by the controller. For example, a controller may allow 5-parameter unipolar, 8-parameter bipolar, and 24-parameter arbitrary waveforms with approximately 1 μs and 1 volt (V) resolution. Actuation parameters for selected waveforms may include:

1. Unipolar Waveform: $\{t_{rise}, t_{dwell}, t_{fall}, V_{peak}, V_{idle}\}$
2. Bipolar Waveform: $\{t_{rise_1}, t_{dwell_1}, t_{fall}, t_{dwell_2}, t_{rise_2}, V_{peak_1}, V_{peak_2}, V_{idle}\}$
3. M-Shaped Waveform: $\{t_{rise_1}, t_{dwell_1}, t_{fall_1}, t_{dwell_2}, t_{rise_2}, t_{dwell_3}, t_{fall_2}, V_{peak_1}, V_{peak_2}, V_{peak_3}, V_{idle}\}$
4. IV-Shaped Waveform: $\{t_{fall_1}, t_{dwell_1}, t_{rise_1}, t_{dwell_2}, t_{fall_2}, t_{dwell_3}, t_{rise_2}, V_{peak_1}, V_{peak_2}, V_{peak_3}, V_{idle}\}$ Rise and fall times restrained to narrow ranges (e.g., approximately 2 to 5 μs) and symmetry (e.g., keeping all rise and fall times approximately the same) may reduce the size of the space evaluated. However, unconstrained and asymmetric waveform designs may allow long rise and fall times without any symmetry that may allow a more exhaustive exploration of jetting performance and jettability. The timing parameters may also range from the minimum allowed by a particular controller in an inkjet device up to values exceeding timing parameters typically seen in manually tuned inkjet devices.

Head pressure is another parameter that may be controlled to enable jetting of microdroplets. Negative head pressure enhances the formation of Worthington Jets, wherein a fluid filament of narrower diameter than the orifice forms and creates extremely small microdrops. When coupled with complex waveforms, the specification of head pressure may enhance this effect, especially for high surface tension fluids.

FIG. 1 illustrates an exemplary precision inkjet system 100 in accordance with some embodiments of the present disclosure. Inkjet system 100 is configured to deposit a fluid, such as ink, onto a substrate 102 based on automated tuning algorithm in accordance with some embodiments of the present disclosure. Inkjet system 100 is configured to provide tuning operations with a piezoelectric element as discussed above. However, embodiments of the present disclosure may be utilized with other inkjet systems 100, such as thermal systems, electrohydrodynamic systems, and other suitable mechanisms.

Inkjet system 100 may include inkjet device 104. In some embodiments, inkjet device 104 may have a controller 106 and a print head 108. Controller 106 may include any system, device, or apparatus operable to interpret and/or execute program instructions and/or process data, and may include, without limitation, a microprocessor, microcontroller, digital signal processor (DSP), application specific integrated circuit (ASIC), or any other digital or analog circuitry configured to interpret and/or execute program instructions and/or process data. Controller 106 may be any device that is operable to select and process a pressure waveform. For example, controller 106 may be a Microfab JetDrive III controller allows 5-parameter unipolar, 8-parameter bipolar, and 24-parameter arbitrary waveforms with approximately 1 μs and 1 volt (V) resolution.

Print head 108 may be any system, device, or apparatus operable to actuate and eject fluid from fluid reservoir 110 for deposition on substrate 102. Print head 108 is communicatively coupled to controller 106 and/or computing device 118. Print head 108 may include piezoelectric element 112 and nozzle 114. Piezoelectric element 112 may be operable to flex (or actuate) based on the pressure waveform transmitted by controller 106. The flexing of the piezoelectric element 112 to expand and contract the inkjet channel, results in a pressure wave which leads to ejection of droplet 116. The fluid in fluid reservoir 110 may be any suitable fluid configured for deposition on substrate 102. For example, the fluid in fluid reservoir 110 may be ink, dimethyl sulfoxide (DMSO), water, isopropanol, ethyl acetate, nanoparticle suspension and/or any other suitable fluid for the particular implementation.

Inkjet system 100 may include a computing device 118 communicatively coupled to controller 106 or other component in inkjet device 104. Computing device 118 may include any component to assist in receiving, transmitting, and/or processing signals. For example, computing device 118 may include processor 120, memory 122, network ports, a display, power supply units, cache, controllers, storage devices, and/or any other suitable components.

Processor 120 may be any system, device, or apparatus operable to interpret and/or execute program instructions and/or process data, and may include, without limitation, a microprocessor, microcontroller, digital signal processor (DSP), application specific integrated circuit (ASIC), or any other digital or analog circuitry configured to interpret and/or execute program instructions and/or process data. In some embodiments, processor 120 may interpret and/or execute program instructions and/or process data stored in memory 122, controller 106, and/or another component of inkjet system 100 and may output results, graphical user interfaces (GUIs), websites, and the like via a display or over a network port.

Memory 122 may be communicatively coupled to processor 120 and may comprise any system, device, or apparatus configured to retain program instructions or data for a period of time (e.g., computer-readable media). Memory 122 may comprise random access memory (RAM), electrically erasable programmable read-only memory (EEPROM), a PCMCIA card, flash memory, magnetic storage, opto-magnetic storage, or any suitable selection and/or array of volatile or non-volatile memory that retains data after power to computing device 118 is turned off.

Inkjet system 100 may further include an image acquisition system 124. Image acquisition system 124 may further include one or more cameras 126. Cameras 126 may be utilized to capture the images of droplets in flight between the nozzle 114 and the substrate 102. External image capture may be utilized because of the absence of in-situ pressure and flow sensors. Cameras 124 may be communicatively coupled to controller 106, computing device 118, a memory, or any other suitable devices operable to record and/or process the images captured by cameras 126. Cameras 126 may be any of a variety of camera types. For example, cameras 126 may be one or more charge coupled device (CCD) cameras. A CCD camera captures images of droplets 116 in flight, which are illuminated by a strobed high brightness light emitting diode (LED) associated with image acquisition system 124. The LED illuminates a set time after each inkjet actuation, creating an image that is the composite of images of multiple droplets 116. The LED strobe delay time may be modified between image captures to create a sequence of video frames showing the formation and flight of droplets 116. In some embodiments, the LED driver may be a rising edge pulse generator where the pulse width is programmable by controller 106, a dedicated field-programmable gate array (FPGA) associated with image acquisition system 124, or an ultra-high-speed switching power metal-oxide-semiconductor field-effect transistor (MOSFET) for high intensity and high speed LED illumination. In some embodiments, a dedicated FPGA may be used to improve the throughput, accuracy and precision. The dedicated FPGA may be used to provide deterministic programmable timing routines for the print head 108, cameras 126, and/or strobe triggering. Using a dedicated FPGA for image processing may increase throughput, which allows faster image acquisition that enables higher resolution imaging and time resolution. Data extracted from the dedicated FPGA may be transmitted directly to an integrated system controller (e.g., controller 106), a processor (e.g., processor 120 in computing system 118), or a remote computing system either via a wired connection or wirelessly. The transmitted data may be stored and/or used for later processing such as droplet tracking, and/or waveform generation and optimization, as discussed below.

Image clarity may be enhanced by using a high intensity flash over a short (e.g., approximately 20 nano-seconds (ns)) duration, which may reduce motion blur and capture single events (no composite) in ultra-high resolution. As another example, cameras 130 may one or more complementary metal-oxide semiconductor (CMOS) cameras with a frame rate of 10 kHz to 1 MHz. A CMOS camera may get a sequence of multiple images of the same droplet 116. Using a CMOS camera may generate images are not composites, which allows slow or otherwise unpredictable droplets 116 to be tracked with clarity. Moreover, a CMOS camera may enable tracking of multiple droplets 116 at the same position to verify repeatability, tracking of droplets 116 at different sets of locations by varying the time between actuation and image capture, and tracking a sequence of droplets 116 from rest or at steady state conditions. With CMOS cameras the appropriate resolution may be selected based on desired cost and/or the signal to noise ratio.

Image acquisition system 124 may further include one or more microscopes for magnification of the captured images. For example, image acquisition system 124 may include a long-working distance objective microscope, or a microscope with a telecentric lens to correct magnification errors resulting from the motion of droplets 116.

Figure 2A:
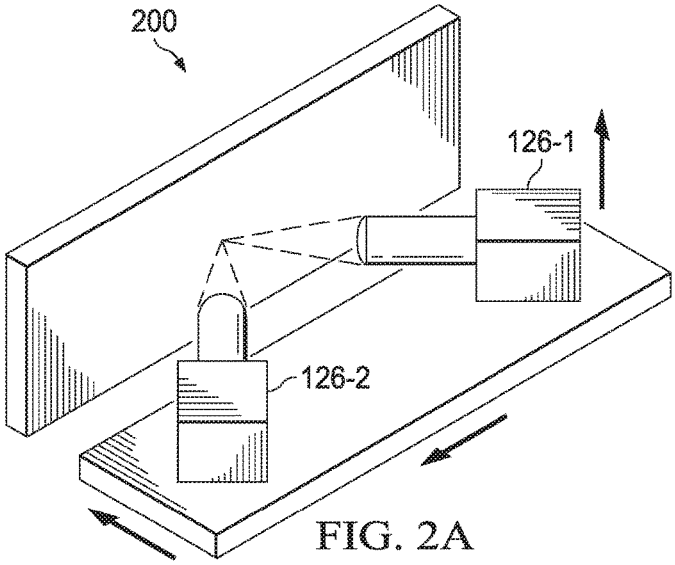
FIG. 2A is schematic diagram of a camera configuration in a precision inkjet system.
Figure 2B:
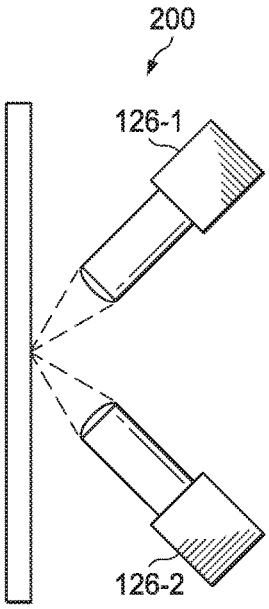
FIG. 2B is a schematic diagram of the camera configuration of FIG. 2A viewed from a different angle.

Although FIG. 1 illustrates a single print head 108 with a single nozzle 114, in some embodiments, a single print head 108 may include two or more nozzles 114. In such a configuration, the image acquisition system 124 may include functions for scanning and three-dimensional (3D) tracking capability. As an example, FIG. 2A and FIG. 2B illustrate an exemplary configuration 200 for cameras 126-1 and 126-2 in accordance with some embodiments of the present disclosure. Configuration 200 includes cameras 126-1 and 126-2 that may be large wide-angle cameras with telescopic lenses that detect gross faults by comparing trajectories of droplets 116 ejected from neighboring nozzles. Cameras 126-1 and 126-2 may be positioned at an approximately 90-degree angle on the horizontal plane such that their image spaces intersect through their central vertical axis. The cameras 126-1 and 126-2 scan in parallel with the line of inkjet orifices.

A method for precision inkjet printing may be performing using inkjet system 100 shown in FIG. 1. The steps of the method may be performed by various computer programs, models or any combination thereof. The programs and models may include instructions stored on a computer-readable medium and operable to perform, when executed, one or more of the steps described below. The computer-readable media may include any system, apparatus or device configured to store and/or retrieve programs or instructions such as a microprocessor, a memory, a disk controller, a compact disc, flash memory or any other suitable device. The programs and models may be configured to direct a processor or other suitable unit to retrieve and/or execute the instructions from the computer readable media. For example, the precision inkjet printing method may be executed by controller 106, processor 120, a dedicated FPGA, a user, and/or other suitable source. For illustrative purposes, the method may be described with respect to an example inkjet printing system 100; however, the method may be used to for precision inkjet printing using any inkjet printing system.

The method may begin and a signal to begin printing may be received by the inkjet printer. For example, with reference to FIG. 1, a signal may be received by controller 106 from computing system 118, a network, or other suitable system.

The method continues and the controller selects an initial pressure waveform and actuation parameters. For example, a waveform such as a Unipolar, Bipolar, M-Shaped, or W-Shaped waveforms may be selected. The actuation parameters may be selected and may include dwell times, rise times and voltages.

The controller transmits a signal to the piezoelectric element based on the selected waveform and actuation parameters. The piezoelectric element receives the signal from the controller and actuates based on the received signal. Due to the actuation of the piezoelectric element, one or more droplets are ejected from the print head at the nozzle. During the deposition of the droplet on the substrate, the controller transmits a signal to the image acquisition system to acquire images of the droplet.

After acquiring the desired images, the acquired images are transmitted to the controller, a computer, a separate FPGA, and/or other processing system. The acquired images are processed to determine the volume and velocity of the droplets. In some embodiments, a region of interest of the acquired images may be defined by calibrating against specific features on the nozzle and/or based on user specification.

The method continues and the acquired images are transformed into binary images. Transformation into binary images may include multiple processing steps. For example, the acquired images may processed by thresholding (e.g., the reduction of a gray level image into a binary image), which may include determining global thresholds using Otsu's method, Gaussian mixture model clustering, entropy maximization, and/or image moment preservation; determining local thresholds using a local background correction added to the global threshold, and/or a Niblack local threshold; and performing edge detection. The acquired images may be further filtered by removing particles and/or noise, morphological filtering/smoothing, and/or hole filling.

Next, the acquired images may be processed using blob detection, which captures and categorizes binary images of the nozzle, fluid meniscus, and ejected droplets. Grayscale images of each droplet may be resampled from the original image using the bounds detected from the binary image to enable alternative local processing of droplets for higher accuracy and speed. Also, in some embodiments, canny edge detection and/or local thresholding may be used on extracted images to estimate best droplet silhouette.

Following processing of the acquired images, the volume of each of the acquired images may be estimated. The volume estimation may include one or more processes. For example, the volumes may be estimated for each acquired image by disc integration and/or pixel to micron conversion. The error in the volume estimates may be minimized by designed morphological filtering to reduce variation of droplet volume estimates resulting from image quantization and transient droplet deformations, image de-blurring based on droplet velocity to obtain more accurate droplet images, and/or taking higher resolution images to reduce quantization error.

After initial estimation and error reduction, the final volume estimates for each acquired image may be determined via interpolation of robust least squares curve fitting of the time series of the initial estimates of instantaneous volume at a calibration position or the closest recorded position. The calibration position may be the droplet position for which the microscope is focused. The calibration position may be close enough to the nozzle that droplets are not blurred, but far enough from the nozzle that the vast majority of droplets have detached before reaching the calibration position. Droplets that have not yet detached may be estimated by interpolating the estimated volume curve at the nearest recorded position to the calibration position.

Additionally, distortion of droplets may also increase as the distance of the droplets from the inkjet increases. Multiple methods may be used for correction of distortion. For example, telecentric imaging may correct out of plane magnification distortions. High-speed imaging or high intensity/short duration strobing may correct distortions related to composite imaging of droplets with increasing positional uncertainty. Least squares weighting based on measurement reliability vs. position diminishes nonlinear distortions and measurement drifting.

After estimating final volumes for the droplets, the droplet velocities may be estimated. For example, the droplet velocities may be estimated by robust least squares fitting of droplet positions at multiple time stamps. The centroid of a droplet may be chosen as the reference point for inferring the position of a droplet at any given time stamp. A droplet is assumed to be axisymmetric with respect to an axis which is parallel to the direction of travel of the droplet. In some situations, which is the no-fault case, the droplet is traveling vertically down. Then, the droplet is axisymmetric with respect to a vertical axis which is the same as the axis of the nozzle wherein the nozzle is treated like a vertical cylinder. From the image processing, the side view provides a cross-section of the droplet at any given time stamp. This combined with the assumption of axisymmetric geometry discussed above, and the assumption that the liquid is incompressible provides the ability to calculate the volumetric centroid, which is the same as the center of mass of the droplet at that given time stamp. The direction of droplet travel may also be estimated from this method of tracking centroid position as a function of time. If the direction varies substantially from the nominal direction, a fault may exist, such as excessive air flow, partial clogging, and/or other fault conditions.

Based on the estimated final droplet volumes and the estimated droplet velocities, an automatic waveform tuning algorithm (described below) is applied to the actuation parameters of the pressure waveform. The waveform tuning algorithm adjusts the actuation parameters to optimize the future droplet volumes and velocities based on target droplet volumes and velocities and one or more optimization goals as described below. The optimization may be conducted through a genetic algorithm sequence, as described in this disclosure.

Although the method for precision inkjet printing is described in a particular sequence of steps, the steps may be performed in any suitable sequence. Additionally, steps may be added to the method or steps may be removed from the method in some embodiments of the present disclosures. One or more of the method steps may be repeated during further optimization of the precision inkjet printing process.

In some embodiments, by combining high resolution precision imaging, high speed single event stroboscopic illumination and high resolution telecentric magnification, droplet volumes ranging from approximately 1 pico-Liter (pL) to approximately 100 pL may be measured with a resolution of approximately 0.1 pL, and detection of satellite drops may be measured with a resolution of approximately 0.01 pL. When combined with the automatic waveform tuning algorithm (described below) and precision-regulated pressure control, droplet volumes within approximately +/−0.1 pL of target volumes may be achieved.

Another aspect of the precision inkjet printing system is tracking of the droplets. For example, droplet volumes and tip, tail and centroid positions may be used for droplet tracking. Both, heuristic methods and predictive modeling/statistical hypothesis detection may be used to correctly associate recorded or estimated droplet volumes for the purpose of detecting anomalies and/or faults such as large changes in droplet position and/or droplet volume. These anomalies and/or faults may then be classified as droplets merging, splitting, or exiting the field of view, missed detections, or false positive detections based on specified criteria. The specified criteria may include merging, such as droplet volume increases by volume of adjacent droplet detected in previous frame but not current frame; splitting, such as a new droplet detected at a position between the positions detected in a previous frame where the new droplet volume, when summed with an adjacent droplet, is approximately equal to the volume of that droplet in the previous frame; and/or exiting the field of view, such as one less droplet detected while remaining droplet positions and volumes jump to values approximately equal to droplet volume shifted by one column for the previous frame.

In some embodiments, the droplet volume estimations may be experimentally verified using precision mass measurements. For example, the inkjet system may be configured to eject a particular fluid, such as dimethyl sulfoxide (DMSO), into a vial on an approximately 0.1 milligram (mg) resolution. The selection of the particular fluid, such as DMSO, may be based on a low evaporation rate and high density. The inkjet system may be tuned to eject approximately 100 pL drops at a high drop rate of 1 kilo-Hertz (kHz) or more. The droplets may be ejected continuously while a balance reading may be recorded by an analysis program, such as Labview. Simultaneous volume estimates from the precision inkjet printing system may be recorded and correlated with the balance readings. An instantaneous velocity curve may be generated and used to identify the region of interest for correlating the balance readings with the volume estimation. The instantaneous velocity curve may be further observed to determine quantization error between the droplet volume estimates and the balance readings. The observed quantization error may be subsequently used to identify and eliminate sources of error, and to develop an error correction factor from design-of-experiments (DOE) studies at various droplet sizes and velocities. Higher resolution balances may assist in achieving higher accuracy calibration, for example, at a resolution of approximately 0.1 micrograms (μg).

The volume estimates from the acquired images may be used to modify the pressure waveform and/or actuation parameters by stochastic optimization via a method such as genetic algorithms. In this technique, a target volume is specified and the velocity may be specified to be above a given value.

Ideally, only one droplet should be ejected from the inkjet and that droplet is approximately the same volume as the target volume. The uncertainty associated with the droplet volume measurement should be low, and the droplet velocity should be above a specified minimum droplet velocity. The minimum droplet velocity specification substantially ensures droplet placement accuracy on the substrate. This may be augmented with a maximum droplet velocity specification as well to minimize the effect of droplet splashing upon contact with the substrate. Further, embodiments of the present disclosure may be used for fine tuning of one inkjet device to another inkjet device, or multiple nozzles on the same print head to each other.

In some embodiments, there exist multiple optimization goals that may need to be balanced by adjusting actuation parameters. For example, an optimization routine may include attempting to ensure that the lead droplet volume is approximately equal to the target droplet volume, which may be realized by minimizing the square of the lead droplet volume error using the following equation:

$$e_{lead\ volume}=(\mathbb{V}_1-\mathbb{V}_t)^2 \tag{1}$$

where:

$\mathbb{V}_1$ represents the volume of the first droplet (or the lead droplet); and $\mathbb{V}_t$ represents the volume of the target droplet.

The optimization routine may also include attempting to ensure that the total volume delivered by the nozzle should be equal to the target droplet volume, which may be realize by minimizing the square of the total volume error using the following equation:

$$e_{total\ volume}=\left(\sum_k \mathbb{V}_k-\mathbb{V}_t\right)^2 \tag{2}$$

where:

$\mathbb{V}_k$ represents the $k^{th}$ droplet with the $1^{st}$ droplet being the lead droplet.

Further, the optimization routine may include minimizing the estimate uncertainty for the volume measurement, which allows results close enough to the target that they are within the measurement uncertainty to be of comparable fitness, and also prevents false positives from adversely affecting the optimization. This error is expressed as:

$$e_{volume\ uncertainty}=\underline{\sigma}_{\mathbb{V}}^T\underline{\sigma}_{\mathbb{V}} \tag{3}$$

where:

$\underline{\sigma}_{\mathbb{V}}$ represents the vector of uncertainties associated with the measurements of each droplet.

The droplet velocity should be at or above a minimum target velocity. This inequality constraint penalty may be expressed by a sigmoid function with a negative argument:

$$e_{speed}=\sum_k \frac{1}{1+e^{-\left(\frac{s_k-s_t}{b}\right)}} \tag{4}$$

where:

$s_k$ represents the velocity of the $k^{th}$ droplet; and $s_t$ represents the target minimum droplet velocity.

The droplet travel direction should be nominally perpendicular to the plane of the nozzle within appropriate tolerances based on desired droplet placement accuracy on the substrate. Jetting outside of this window may also be penalized in the objective function, similar to the penalty on jetting speed.

Any combination of the optimization goals and routines illustrated in Equations (1)-(4) may be captured by the fitness function (used interchangeably with objective function), which is maximized by an optimization routine, such as genetic algorithms. Multiple types of fitness functions are useful for error minimization. In some embodiments, the fitness function may be expressed as the negated weighted sum of the errors using the following equation, where A represents the relative weights of each error:

$$f_j=-\sum_i A_i e_i$$

For example:

$$f_j = -(A_1 e_{lead\ volume} + A_2 e_{total\ volume} + A_3 e_{volume\ uncertainty} + A_4 e_{speed})$$

$$f_j = -\left(A_1(\mathbb{V}_1 - \mathbb{V}_t)^2 + A_2\left(\sum_k \mathbb{V}_k - \mathbb{V}_t\right)^2 + A_3 \underline{\sigma}_{\mathbb{V}}^T \underline{\sigma}_V + A_4 \sum_k \frac{1}{1 + e^{-\left(\frac{s_k - s_t}{b}\right)}}\right)$$

The fitness may be expressed as the reciprocal of the sum of the errors:

$$f_j = \frac{1}{\Sigma_i A_i e_i}$$

For example:

$$f_j = \frac{1}{A_1 e_{lead\ volume} + A_2 e_{total\ volume} + A_3 e_{volume\ uncertainty} + A_4 e_{speed}}$$

$$f_j = \frac{1}{A_1(\mathbb{V}_1 - \mathbb{V}_t)^2 + A_2(\Sigma_k \mathbb{V}_k - \mathbb{V}_t)^2 + A_3 \underline{\sigma}_{\mathbb{V}}^T \underline{\sigma}_{\mathbb{V}} + A_4 \Sigma_k \frac{1}{1 - e^{-\left(\frac{s_k - s_t}{b}\right)}}}$$

The fitness function may be expressed as the sum of Gaussians and positive argument sigmoids:

$$f_j = \sum_i A_i e^{-\frac{e_i\ square\ error}{a_i}} + \sum_i B_i\left(\sum_k \frac{1}{1 + e^{\left(\frac{s_k - s_t}{b}\right)}}\right)$$

For example:

$$f_j = A_1 e^{\frac{e_{lead\ volume}}{a_1}} + A_2 e^{\frac{e_{total\ volume}}{a_2}} + A_3 e^{\frac{e_{volume\ uncertainty}}{a_3}} + B\sigma(e_{speed})$$

$$f_j = A_1 e^{\frac{(\mathbb{V}_1 - \mathbb{V}_t)^2}{a_1}} + A_2 e^{\frac{(\Sigma_k \mathbb{V}_k - \mathbb{V}_t)^2}{a_2}} + A_3 e^{\frac{\underline{\sigma}_{\mathbb{V}}^T \underline{\sigma}_{\mathbb{V}}}{a_3}} + B \sum_k \frac{1}{1 + e^{\left(\frac{s_k - s_t}{b}\right)}}$$

Fitness functions of the forms:

$$f_j = \frac{1}{\Sigma_i A_i e_i}$$

and $$f_j = \sum_i A_i e^{-\frac{e_i\ square\ error}{a_i}} + \sum_i B_i\left(\sum_k \frac{1}{1 + e^{\left(\frac{s_k - s_t}{b}\right)}}\right)$$

are able to be normalized by the sum $\Sigma_j f_j$ and are therefore well suited for fitness proportional selection (also called roulette wheel selection, which is one of multiple methods for genetic algorithm optimization propagated in a stochastic manner), wherein the probability of selection for recombination is equal to:

$$P_{selection}(j) = \frac{f_j}{\Sigma_j f_j}$$

Fitness functions of the form:

$$f_j = -\sum_i A_i e_i$$

may not be easily able to be normalized by the sum $\Sigma_j f_j$ and may be best suited to tournament selection (another technique for propagation of genetic algorithm optimization), wherein randomly selected pairs of individuals are selected for recombination by the comparison of the fitness functions. More than one consecutive tournament may be used to increase selection pressure so that selection results are biased towards higher fitness results. Based on the desired optimization sequence, appropriate selection, fitness function and other parameters of the tuning algorithm can be chosen.

Due to the highly nonlinear nature of droplet formation in relation to waveform parameters, stochastic optimization routines such as genetic algorithms are useful for model-free exploring high dimensional waveform spaces. In genetic algorithms, waveforms are selected for genetic crossover based on their fitness to create the next generation of waveforms. The waveforms are also randomly mutated in order to diminish chances of becoming trapped in a local minima. The fitness-selection-crossover-mutation routine is effective at evolving the population to maximize the fitness function. Optimization routines of the present disclosure may result in droplets whose volume measurements closely match the target volumes. Further, droplet resolution may be enhanced by optimizing towards small volumes. Other optimization routines may include methods of steepest descent, simulated annealing, pattern search and other algorithms, including hybrid combinations thereof, based on the desired input and output properties of the algorithm.

The automated tuning algorithm using the disclosed optimization routines combines image based sensing of droplets generated by the application of banks of waveforms with genetic fitness evaluation to create new banks of waveforms in order to search for waveforms that maximize the fitness related to achieving target droplet volumes. The optimization routine may also be configured such that it starts with a set point, different from the target volume or velocity, this set point being relatively easier and more stable to jet. The number of parameters may also be reduced for the purpose of simplifying the set point optimization. The best results from this set point optimization may then be used as an initial guess for an increasingly complex, hierarchical optimization routine, where, finally, the target volumes or velocities may be obtained using a control input that has a high number of parameters.

Figure 3:
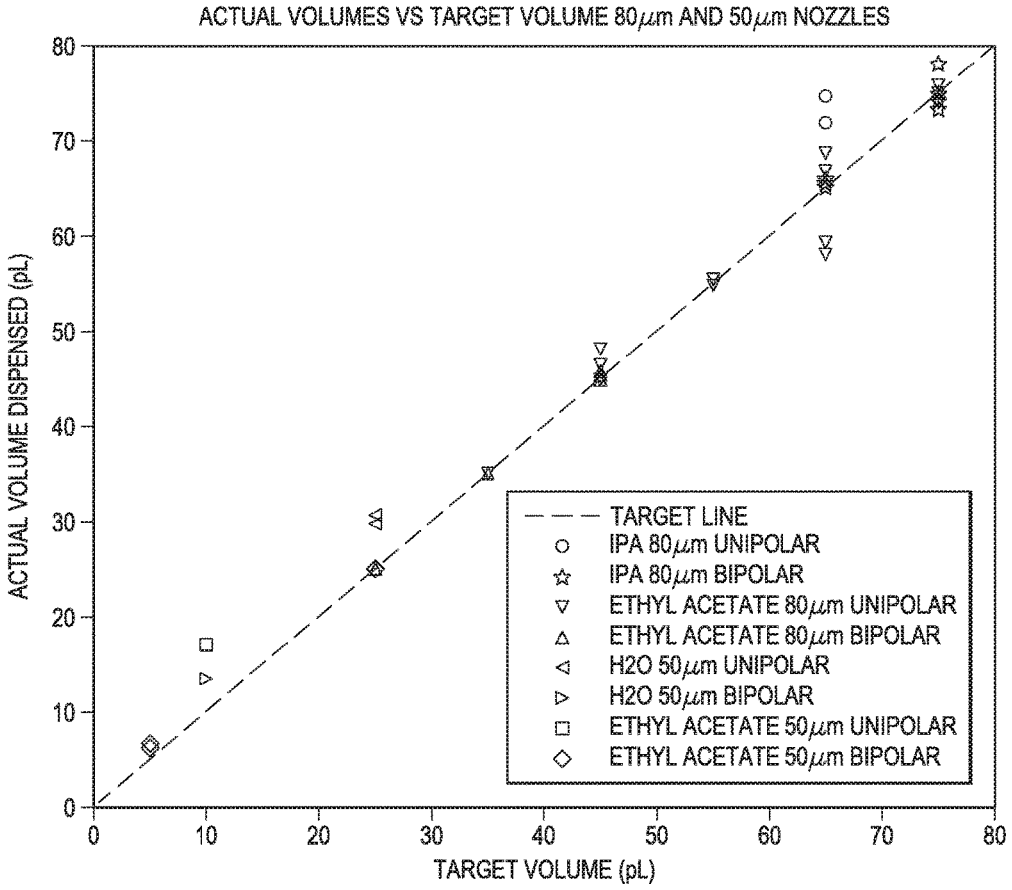
FIG. 3 is a graph of experimental results for actual volume dispensed as a function of the target volume for droplets.
Figure 4:
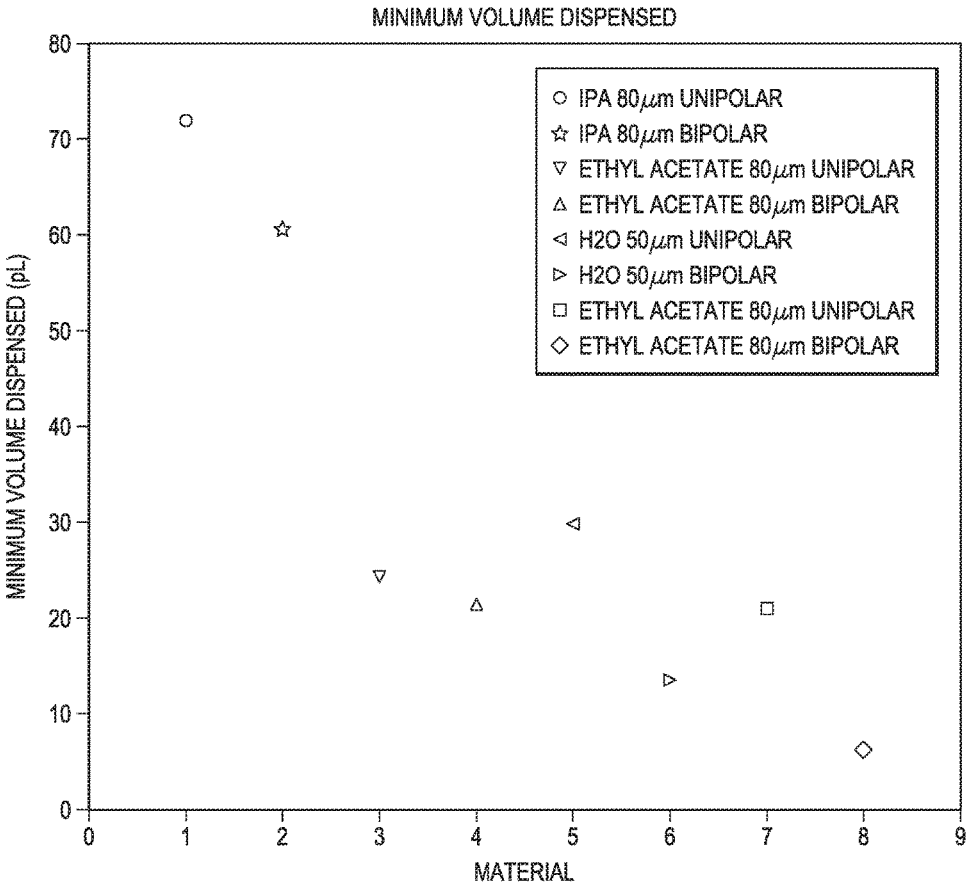
FIG. 4 is a graph of experimental results for and minimum volume dispensed as a function of the fluid material.

FIG. 3 and FIG. 4 illustrate exemplary graphs of experimental results for actual volume dispensed as a function of the target volume for droplets and minimum volume dispensed as a function of the fluid material. The exemplary graph includes results from multiple fluids, including water, isopropanol, and ethyl acetate, at various target volumes. Each of the fluids were ejected from 80 μm and 50 μm nozzles at various target volumes. In the experiment, the droplet volumes were minimized using water for the unconstrained unipolar waveform at 29.8 pL and bipolar waveform at 13.5 pL. Ethyl acetate was ejected at a wide range of volumes. Ethyl acetate is a fluid with ultra-low viscosity (0.452 cP) and low surface tension (23.61 dyn/cm). For 80 μm and 50 μm nozzles, the Z number for Ethyl acetate are 64.5 and 51, respectively, which is substantially higher than an upper bound of 40, based on empirical jettability estimates.

Embodiments of the present disclosure may include a method for precision inkjet printing includes determining an actuation parameter associated with a pressure waveform. Based on the pressure waveform, the method also includes actuating a print head to eject a droplet from a nozzle and acquiring an image of the droplet. The method further includes processing the acquired image to estimate a volume of the droplet and based on the estimated volume of the droplet and a target volume, adjusting the actuation parameter.

Each embodiment may have one or more of the following additional elements in any combination: Element 1: wherein the target volume comprises a volume of less than 100picoliters; and wherein adjusting the actuation parameter is further based on the estimated volume of the droplet having a variation from the target volume of less than 15% of 1-sigma from the target volume. Element 2: wherein adjusting the actuation parameter further comprises calculating an error between the estimated volume of the droplet and the target volume of the droplet. Element 3: further comprising optimizing the error using an optimization routine. Element 4: wherein the optimization routine includes selection of an algorithm from among the following exemplar choices: steepest descent, patterned search, golden section search, Monte-Carlo, genetic algorithms, and simulated annealing. Element 5: wherein estimating the volume of the droplet further comprises: establishing a ruler by calibrating a non-varying artifact on the acquired image such as a diameter of the nozzle; estimating a perimeter of the droplet; and estimating the volume of the droplet based on the estimated perimeter of the droplet. Element 6: estimating a diameter of the droplet, the diameter is based on a measurement after the droplet is ejected and before the droplet is deposited on a substrate; adjusting the actuation parameter based on tuning the diameter of the droplet to be less than a diameter of the nozzle. Element 7: wherein actuating the print head is based on selecting a source from among the following: a piezoelectric element, thermal energy, electrical energy, chemical energy, and mechanical energy. Element 8: further comprising controlling a plurality of nozzles to eject a plurality of droplets, each nozzle of the plurality of nozzles is independently controlled. Element 9: wherein the print head is configured to dispense a plurality of fluids, one fluid of the plurality of fluids having a different rheological property than another one fluid of the plurality of fluids. Element 10: wherein a fluid of the plurality of fluids is selected from among the following: a non-Newtonian materials, a 1D nanomaterial suspended in a solvent, and a 2D nanomaterial suspended in a solvent. Element 11: wherein an initial value of the actuation parameter is selected based on a manual tuning process. Element 12: wherein an initial value of the actuation parameter is selected based on a lookup table for known materials. Element 13: wherein an initial value of the actuation parameter is selected based on a set-point volume. Element 14: selecting a first number of a plurality actuation parameters; and selecting a second number of the plurality of actuation parameters based on the first number and an adjustment to the plurality of actuation parameters. Element 15: wherein the acquired images are captured using a live video feed having a frame rate higher than a frequency of ejection of the droplet. Element 16: wherein the acquired images are captured using a live video feed having a stroboscopic illumination from a light source. Element 17: wherein a velocity of ejection of the droplet is greater than 0.1 m/s. Element 18: estimating a velocity of the droplet; based on the estimated velocity being lower than a minimum target velocity and/or greater than a maximum target velocity, calculating an error between the estimated velocity and the minimum and/or maximum target velocity; based on the estimated velocity being more than a minimum target velocity and/or less than a maximum target velocity, setting an error to zero; and optimizing the error using an optimization routine. Element 19: wherein estimating the velocity of the droplet further comprises: establishing a ruler by calibrating a non-varying artifact on the acquired image based on a diameter of the nozzle; detecting a position of the droplet at a plurality of distinct locations; tracking a time stamp for the plurality of distinct locations; and estimating a velocity for the droplet based on the position and the time stamp for the plurality of distinct locations. Element 20: where the fault is characterized and minimized automatically; wherein the fault includes one of the following: large deviation from a target volume; low velocity compared to a target minimum velocity; no dispensed droplet; a single lead droplet with negative velocity and the single lead droplet is pulled back in the nozzle; a single lead drop with undesired lateral velocity; a single lead drop with one or more satellite drops that do not merge before depositing on the substrate; and bleeding of the nozzle. Element 21: wherein the minimizing the fault further comprises solving an optimization function that optimizes an objective function comprising an error associated with the fault. Element 22: wherein the error due to the faults is a combination of one or more of the following: a function of square of difference between volume of a lead droplet and a target volume; a function of square of difference between volume of a lead droplet and an average volume; a function of square of difference between an estimated velocity and a target velocity; a function of square of difference between a direction of velocity of a lead droplet and a direction of a target velocity; and a function of square of difference between volume of a plurality of droplets and a target volume. Element 23: further comprising calibrating performance of a first inkjet device to a second inkjet device. Element 24: further comprising calibrating an inkjet device to dispense a material with an unfavorable Z number.

This disclosure encompasses all changes, substitutions, variations, alterations, and modifications to the example embodiments herein that a person having ordinary skill in the art would comprehend. Similarly, where appropriate, the appended claims encompass all changes, substitutions, variations, alterations, and modifications to the example embodiments herein that a person having ordinary skill in the art would comprehend. Moreover, reference in the appended claims to an apparatus or system or a component of an apparatus or system being adapted to, arranged to, capable of, configured to, enabled to, operable to, or operative to perform a particular function encompasses that apparatus, system, component, whether or not it or that particular function is activated, turned on, or unlocked, as long as that apparatus, system, or component is so adapted, arranged, capable, configured, enabled, operable, or operative.

What is claimed is:

1. A method for precision inkjet printing, comprising:

determining an initial pressure waveform and an associated initial actuation parameter value;

based on the initial pressure waveform, actuating a print head to eject a lead droplet from a nozzle;

acquiring an image of the lead droplet;

processing the acquired image to estimate a volume of the lead droplet;

based on the estimated volume of the lead droplet and a target volume, determining an optimized pressure waveform that actuates the election of a subsequent droplet with the target volume; and adjusting the initial actuation parameter value to an optimized actuation parameter value associated with the optimized pressure waveform by applying an automated tuning algorithm.

2. The method of claim 1, wherein the target volume comprises a volume of less than 100 picoliters; and wherein the actuation parameter value is adjusted to optimize the subsequent droplet with a volume variation of less than 15% of 1-sigma from the target volume.

3. The method of claim 1, wherein determining the optimized pressure waveform comprises calculating an error between the estimated volume of the lead droplet and the target volume.

4. The method of claim 3, further comprising minimizing the error using an optimization routine.

5. The method of claim 1, wherein processing the acquired image to estimate the volume of the lead droplet further comprises:

establishing a ruler by calibrating a non-varying artifact on the acquired image based on a diameter of the nozzle;

estimating a perimeter of the lead droplet; and estimating the volume of the lead droplet based on the estimated perimeter of the droplet.

6. The method of claim 1, further comprising:

estimating a diameter of the lead droplet based on a measurement after the lead droplet is ejected; and applying the automated tuning algorithm so that the diameter of the droplet is less than a diameter of the nozzle.

7. The method of claim 1, wherein actuating the print head is based on selecting a source from among the following: a piezoelectric element, thermal energy, electrical energy, chemical energy, and mechanical energy.

8. The method of claim 1, further comprising independently controlling a plurality of nozzles to eject a plurality of droplets.

9. The method of claim 1, wherein the print head is configured to dispense a plurality of fluids, one fluid of the plurality of fluids having a different rheological property than another one fluid of the plurality of fluids.

10. The method of claim 9, wherein a fluid of the plurality of fluids is selected from among the following: a non-Newtonian materials, a 1D nanomaterial suspended in a solvent, and a 2D nanomaterial suspended in a solvent.

11. The method of claim 1, wherein the initial actuation parameter value is selected based on a manual tuning process.

12. The method of claim 1, wherein the initial actuation parameter value is selected based on a lookup table for known materials.

13. The method of claim 1, wherein the initial actuation parameter value is selected based on a set-point volume.

14. The method of claim 1, further comprising:

selecting a first number of a plurality actuation parameters; and selecting a second number of the plurality of actuation parameters based on the first number and an adjustment to the plurality of actuation parameters.

15. The method of claim 1, wherein the acquired images are captured using a live video feed having a frame rate higher than a frequency of ejection of the droplet.

16. The method of claim 1, wherein the acquired images are captured using a live video feed having a stroboscopic illumination from a light source.

17. The method of claim 1, wherein a velocity of ejection of the droplet is greater than 0.1 m/s.

18. The method in claim 17 further comprising calibrating performance of a first inkjet device to a second inkjet device.

19. The method in claim 17 further comprising calibrating an inkjet device to dispense a material with a Z number over 40.

20. The method of claim 1, further comprising:

estimating a velocity of the droplet;

based on the estimated velocity being less than a minimum target velocity or more than a maximum target velocity, calculating an error between the estimated velocity and the minimum and maximum target velocities;

based on the estimated velocity being more than a minimum target velocity or less than a maximum target velocity, setting an error to zero; and minimizing the error using an optimization routine.

21. The method of claim 20, wherein estimating the velocity of the droplet further comprises:

establishing a ruler by calibrating a non-varying artifact on the acquired image based on a diameter of the nozzle;

detecting a position of the droplet at a plurality of distinct locations;

tracking a time stamp for the plurality of distinct locations; and estimating a velocity for the droplet based on the position and the time stamp for the plurality of distinct locations.

22. The method of claim 1, wherein the automated tuning algorithm automatically minimizes a fault selected from:

a. large deviation from a target volume;

b. low velocity compared to a target minimum velocity;

c. no dispensed droplet;

d. a single lead droplet with negative velocity and the single lead droplet is pulled back in the nozzle;

e. a single lead drop with undesired lateral velocity;

f. a single lead drop with one or more satellites; and g. bleeding of the nozzle.

23. The method of claim 22, wherein minimizing the fault further comprises solving an optimization function that optimizes an objective function comprising an error associated with the fault.

24. The method of claim 23, wherein the error associated with the fault is a combination of one or more of the following:

a. a function of square of difference between volume of the lead droplet and the target volume;

b. a function of square of difference between volume of the lead droplet and an average volume;

c. a function of square of difference between an estimated velocity and a target velocity;

d. a function of square of difference between a direction of velocity of the lead droplet and a direction of the target velocity; and e. a function of square of difference between volume of a plurality of lead droplets and a target volume.

25. The method in claim 1 further comprising calibrating performance of a first inkjet device to a second inkjet device.

26. The method in claim 1 further comprising calibrating an inkjet device to dispense a material with a Z number over 40.

* * * * *